US010254053B2

(12) United States Patent
Okamoto et al.

(10) Patent No.: US 10,254,053 B2
(45) Date of Patent: Apr. 9, 2019

(54) HEAT TRANSFER FIN AND HEAT EXCHANGER USING THEREOF

(71) Applicant: Rinnai Corporation, Nagoya-shi, Aichi (JP)

(72) Inventors: Hideo Okamoto, Nagoya (JP); Akifumi Nishino, Nagoya (JP)

(73) Assignee: Rinnai Corporation, Nagoya-shi (JP)

( * ) Notice: Subject to any disclaimer, the term of this patent is extended or adjusted under 35 U.S.C. 154(b) by 1 day.

(21) Appl. No.: 15/054,345

(22) Filed: Feb. 26, 2016

(65) Prior Publication Data

US 2016/0273850 A1 Sep. 22, 2016

(30) Foreign Application Priority Data

Mar. 16, 2015 (JP) ..... 2015-51698

(51) Int. Cl.
*F28F 1/32* (2006.01)
*F28F 1/02* (2006.01)
(Continued)

(52) U.S. Cl.
CPC ..... *F28F 1/32* (2013.01); *F24H 1/14* (2013.01); *F28D 7/1692* (2013.01); *F28F 1/02* (2013.01);
(Continued)

(58) Field of Classification Search
CPC ..... F28F 2215/08; F28F 1/325; F28F 1/02; F24H 9/18; F24H 1/14; F24H 1/145; F24H 1/147; F28D 2021/0024
See application file for complete search history.

(56) References Cited

U.S. PATENT DOCUMENTS 5,582,244 A * 12/1996 Helms ..... F28F 1/32 165/151
7,004,242 B2 * 2/2006 Gong ..... F28F 1/32 165/151
(Continued)

FOREIGN PATENT DOCUMENTS

JP 57-16740 1/1982
JP 58127092 A * 7/1983 ..... F28F 1/325
(Continued)

OTHER PUBLICATIONS

Min, KR 2010-0047500, May 10, 2010, machine translation.*
(Continued)

*Primary Examiner* — Hung Q Nguyen
*Assistant Examiner* — Mark L. Greene
(74) *Attorney, Agent, or Firm* — Amin, Turocy & Watson LLP

(57) ABSTRACT

A heat transfer fin (31) made of stainless steel-based metal for a heat exchanger, has a plurality of upper stage heat-transfer-tube insertion holes (611), a plurality of lower stage heat-transfer-tube insertion holes formed (612), upper end cut portions (651) formed between the adjacent upper stage heat-transfer-tube insertion holes (611), and lower end cut portions (652) formed between the adjacent lower stage heat-transfer-tube insertion holes (612), wherein the upper end cut portions (651) are formed so as to extend from a fin upper end portion (311) beyond lower ends of the upper stage heat-transfer-tube insertion holes (611) to positions in the vicinity of upper ends of the lower stage heat-transfer-tube insertion holes (612), and the lower end cut portions (652) are formed so as to extend from a fin lower end portion (312) to positions above the lower ends of the lower stage heat-transfer-tube insertion holes (612).

5 Claims, 5 Drawing Sheets

(51) Int. Cl.

| | |
|---|---|
| ***F24H 1/14*** | (2006.01) |
| ***F28D 7/16*** | (2006.01) |
| *F28F 21/08* | (2006.01) |
| *F28D 21/00* | (2006.01) |

(52) U.S. Cl.
CPC .... *F28D 2021/0024* (2013.01); *F28F 21/083* (2013.01); *F28F 2215/04* (2013.01)

(56) References Cited

U.S. PATENT DOCUMENTS

| | | | | |
|---|---|---|---|---|
| 2014/0190425 | A1* | 7/2014 | Oohigashi | F24H 9/0031 122/18.4 |
| 2016/0076815 | A1* | 3/2016 | Chen | F28F 1/32 165/181 |

FOREIGN PATENT DOCUMENTS

| | | | | |
|---|---|---|---|---|
| JP | 60-16875 | | | 2/1985 |
| JP | 06109391 | A | * | 4/1994 |
| JP | 08-226781 | | | 9/1996 |
| JP | 2001-082808 | | | 3/2001 |
| JP | 2002-213825 | | | 7/2002 |
| JP | 2004-037005 | | | 2/2004 |
| JP | 2005156033 | A | * | 6/2005 |
| JP | 2006-292316 | | | 10/2006 |
| KR | 2020000008507 | | | 5/2000 |
| KR | 20100047500 | A | * | 5/2010 |

OTHER PUBLICATIONS

Sasaki, JP 06-109391, Apr. 19, 1994, machine translation.*
Shibamiya, JP 2005-156033, Jun. 16, 2005, machine translation.*
Nishihata, JP 2004-37005, Feb. 5, 2004, machine translation.*
Kunichika, JP 58-127092, Jul. 28, 1983, machine translation.*

* cited by examiner

HEAT TRANSFER FIN AND HEAT EXCHANGER USING THEREOF

BACKGROUND OF THE INVENTION

Field of the Invention

The present invention relates to a heat transfer fin for a heat exchanger accommodated in a combustion device and the heat exchanger using thereof.

Description of the Related Art

A conventional heat exchanger accommodated in a combustion device, such as a water heater and a heat source device for a room heater, includes a heat exchanger body having an upper opening and a lower opening, a plurality of heat transfer fins, and a plurality of heat-transfer tubes. The plurality of heat transfer fins are disposed in parallel with each other in the longitudinal direction of the heat exchanger body with predetermined clearances between the respective heat transfer fins. The plurality of heat-transfer tubes are disposed so as to penetrate the heat transfer fins in the direction perpendicular to each of the heat transfer fins. According to this type of heat exchanger, the heat transfer fins and the heat-transfer tubes are both made of copper-based metal having high heat conductivity for increasing thermal efficiency. (For example, Japanese Unexamined Patent Publications No. 2001-82808 A and No. 2004-37005 A)

When the conventional heat exchanger recovers latent heat from combustion exhaust gas introduced into the heat exchanger to increase thermal efficiency, steam contained in the combustion exhaust gas condenses on the surfaces of the heat transfer fins into drain. A large amount of drain adhering to and remaining at lower ends of the heat transfer fins may close the clearances between the respective heat transfer fins and obstruct flow of the combustion exhaust gas, which result in lowering thermal efficiency. Further, the combustion exhaust gas contains a large amount of nitrogen oxide. Accordingly, when such acid drain adheres to and remains on the surfaces of the heat transfer fins, the heat transfer fins may corrode.

From the view point of corrosion resistance to the drain, some combustion devices may include heat transfer fins made of stainless steel-based metal. However, heat conductivity of stainless-based metal is inferior to that of copper-based metal. Accordingly, the respective heat transfer fins made of stainless steel-based metal may have partial overheated portions at areas away from the heat-transfer-tube insertion holes, which results in deforming or damaging the heat transfer fins. As a result, thermal efficiency lowers rather than improves. Moreover, residual heat of the heat transfer fins remaining after an operation stop increases as the heat conductivity of the heat transfer fins decreases. Accordingly, due to a so-called post-boiling phenomenon caused by heat transmitted from the heat transfer fins to hot water within the heat-transfer tubes, there is a problem that an initial hot water outlet temperature given to a hot-water supplying terminal may become higher than a set temperature at the time of a restart of operation.

SUMMARY OF THE INVENTION

The present invention has been made to solve the problems described above, and an object of the present invention is to increase thermal efficiency of a heat exchanger, and prevent supply of hot water having a high outlet temperature at a restart of operation due to a post-boiling phenomenon.

According to one aspect of the present invention, there is provided a heat transfer fin made of stainless steel-based metal for a heat exchanger, wherein the heat exchanger has a heat exchanger body in which combustion exhaust gas flows from an upper opening toward a lower opening, and a plurality of the heat transfer fins disposed between two opposed side walls of the heat exchanger body, wherein the heat transfer fins are arranged in parallel with a predetermined clearance therebetween, each of the heat transfer fins comprising:

a plurality of upper stage heat-transfer-tube insertion holes each of which has a substantially elliptical shape elongated in the vertical direction, formed in an upper stage;

a plurality of lower stage heat-transfer-tube insertion holes each of which has a substantially elliptical shape elongated in the vertical direction, formed in an lower stage;

upper end cut portions formed between the adjacent upper stage heat-transfer-tube insertion holes; and lower end cut portions formed between the adjacent lower stage heat-transfer-tube insertion holes, wherein centers of the upper and lower stage heat-transfer-tube insertion holes are displaced from one another in the transverse direction, the upper end cut portions are formed so as to extend from a fin upper end portion beyond lower ends of the upper stage heat-transfer-tube insertion holes to positions in the vicinity of upper ends of the lower stage heat-transfer-tube insertion holes in the vertical direction, the lower end cut portions are formed so as to extend from a fin lower end portion to positions above lower ends of the lower stage heat-transfer-tube insertion holes in the vertical direction, and a width of each of the lower end cut portions in the transverse direction increases downward.

According to another aspect of the present invention, there is provided a heat exchanger comprising:

the heat transfer fins described above;

a heating exchanger body; and a plurality of heat-transfer tubes each of which has a substantially elliptic cross-sectional shape elongated in the vertical direction, wherein each of the heat-transfer tubes is inserted through the corresponding upper stage heat-transfer-tube insertion holes or the corresponding lower stage heat-transfer-tube insertion holes of the heat transfer fins in the direction perpendicular to the heat transfer fins between two opposed side walls of the heat exchanger body.

Other objects, features and advantages of the present invention will become more fully understood from the detailed description given hereinbelow and the accompanying drawings which are given by way of illustration only, and thus are not to be considered as limiting the present invention.

PREFERRED MODE FOR CARRYING OUT THE INVENTION

Hereinafter, referring to drawings, a heat transfer fin and a heat exchanger having the heat transfer fin according to an embodiment of the present invention will be described in detail.

Figure 1:
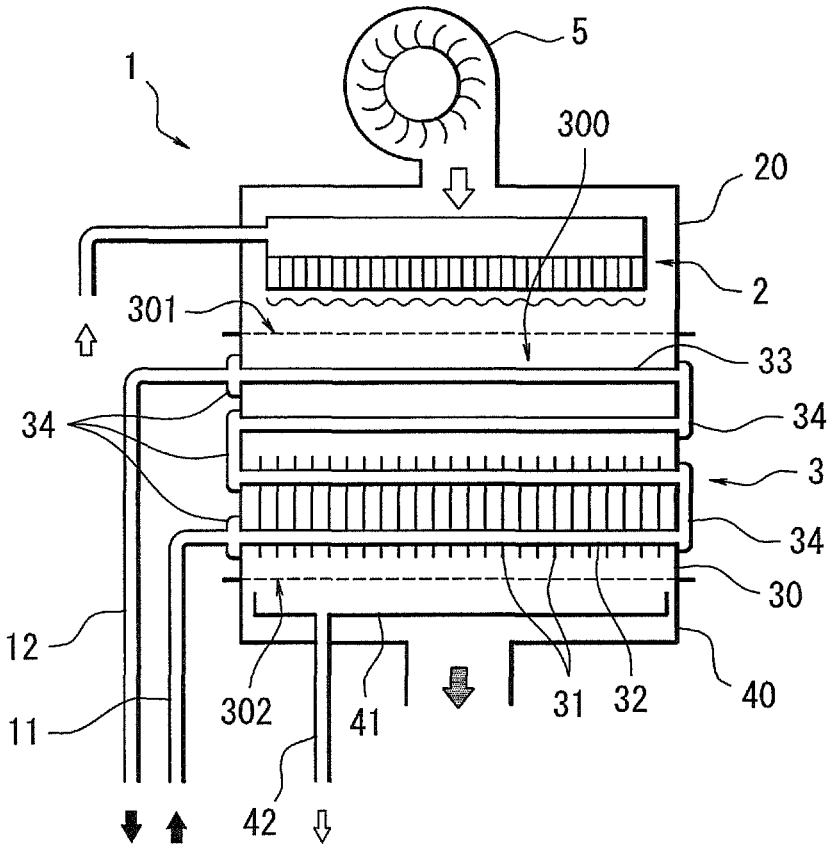
FIG. 1 is a schematic configuration diagram showing one example of a heat exchanger having heat transfer fins according to an embodiment of the present invention.

As illustrated in FIG. 1, a heat exchanger 3 having a heat transfer fin 31 according to the present embodiment is accommodated in a combustion device, such as a water heater and a heat source device for a room heater. The heat exchanger 3 is configured such that water supplied from a water supply pipe 11 to first heat-transfer tubes 32 and second heat-transfer tubes 33 is heated by heat exchange with combustion exhaust gas released from a gas burner 2 and supplied to a hot-water supplying terminal (not-shown) via a hot-water supply pipe 12.

A body (heat exchanger body) 30 which constitutes an outer case of the heat exchanger 3 has a substantially rectangular box shape, and includes an upper opening 301 and a lower opening 302 opened to above and below, respectively. The upper opening 301 is connected to a combustion chamber housing 20 containing the gas burner 2. On the other hand, the lower opening 302 is connected to an exhaust gas chamber housing 40 leading the combustion exhaust gas released from the gas burner 2 out the water heater 1.

A fan unit 5 is connected to an upper portion of the combustion chamber housing 20. The fan unit 5 supplies air outside the water heater 1 into the combustion chamber housing 20 as combustion air for the gas burner 2. After the combustion exhaust gas released from the gas burner 2 and the air supplied into the combustion chamber housing 20 by the fan unit 5 are introduced through the upper opening 301 into the body 30 of the heat exchanger 3, those are discharged from the lower opening 302 to the outside of the water heater 1 through the exhaust gas chamber housing 40. The exhaust gas chamber housing 40 includes a drain receiver 41 for receiving drain generated on the surfaces of the heat transfer fins 31 at the time of recovery of latent heat from the combustion exhaust gas by the heat exchanger 3. The drain collected on the drain receiver 41 is discharged from a drain pipe 42 to the outside via a drain neutralizer (not-shown).

Figure 2:
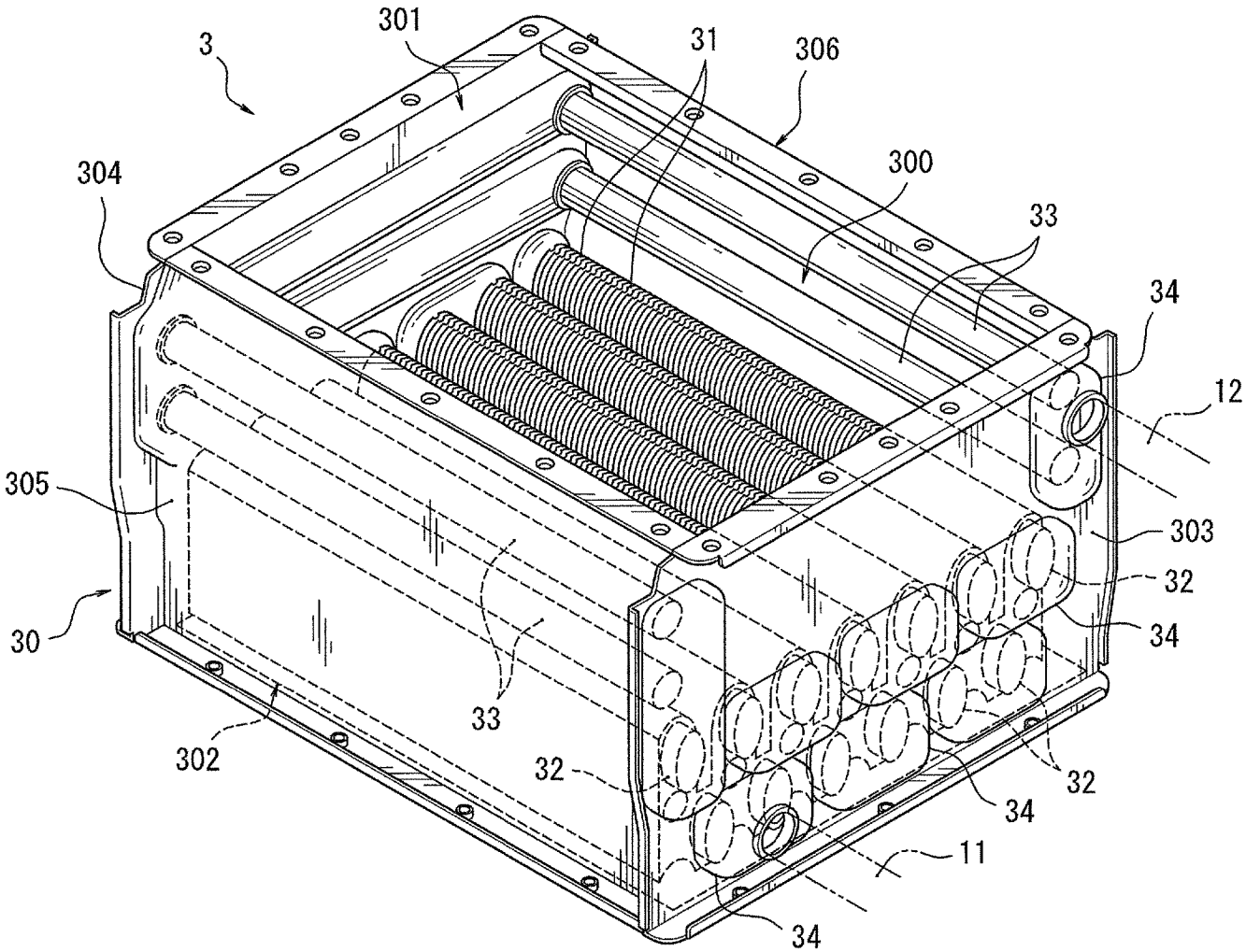
FIG. 2 is a perspective view from a left-front upper position showing one example of the heat exchanger having the heat transfer fins according to an embodiment of the present invention.

As illustrated in FIG. 2, the body 30 includes a front side wall 303 and a rear side wall 304 facing each other. A plurality of the plate-shaped heat transfer fins 31 made of stainless steel-based metal are arranged with a predetermined clearance therebetween and disposed in parallel with each other along with the longitudinal direction of the body 30 between the front side wall 303 and the rear side wall 304. Further, the plurality of first heat-transfer tubes 32 and the plurality of second heat-transfer tubes 33, each of which is a straight tube made of stainless steel-based metal, extend between the opposed front side wall 303 and rear side wall 304 of the body 30. In the following description of the present specification, the outside surface of the front side wall 303 corresponds to the front of the heat exchanger 3, the depth direction as viewed from the front of the body 30 corresponds to the longitudinal direction and the width direction and the height direction as similarly viewed correspond to the transverse direction and the vertical direction, respectively.

The first heat-transfer tubes 32 are arranged in a so-called staggered shape within a substantially lower half space inside the body 30 such that the first heat-transfer tubes 32 are divided into two stages of an upper stage and a lower stage in the vertical direction and tube centers of the first heat-transfer tubes 32 in the upper stage and tube centers of the first heat-transfer tubes 32 in the lower stage are displaced from one another by a half pitch in the transverse direction. Each of the first heat-transfer tubes 32 has a substantially elliptical cross-sectional shape elongated in the vertical direction. The second heat-transfer tubes 33 are disposed in parallel with each other along left and right side walls 305, 306 within a substantially upper space inside the body 30. Each of the second heat-transfer tubes 33 has a substantially circular cross-sectional shape. Accordingly, a part of sensible heat contained in the combustion exhaust gas introduced from the upper opening 301 into the body 30 is recovered by the second heat-transfer tubes 33, and then sensible heat and latent heat contained in the combustion exhaust gas are further recovered by the first heat-transfer tubes 32. As such, the second heat-transfer tubes 33 is provided near the upper opening 301 inside the body 30 along the side walls 305, 306 to prevent the side walls 305, 306 from overheating.

Tube ends of the first heat-transfer tubes 32 are connected to those of the second heat-transfer tubes 33 via connecting headers 34 outside the front side wall 303 and the rear side wall 304, whereby one heat exchange tube path 300 is formed (see FIG. 1). The water supply pipe 11 is connected to the connecting headers 34 on the inlet side of the heat exchange tube path 300, while the hot-water supply pipe 12 is connected to the connecting headers 34 on the outlet side of the heat exchange tube path 300. Accordingly, water supplied to the inlet side connecting headers 34 via the water supply pipe 11 flows through the first heat-transfer tubes 32 and the second heat-transfer tubes 33 in this order, and flows to the hot-water supply pipe 12 via the outlet side connecting headers 34.

Figure 3:
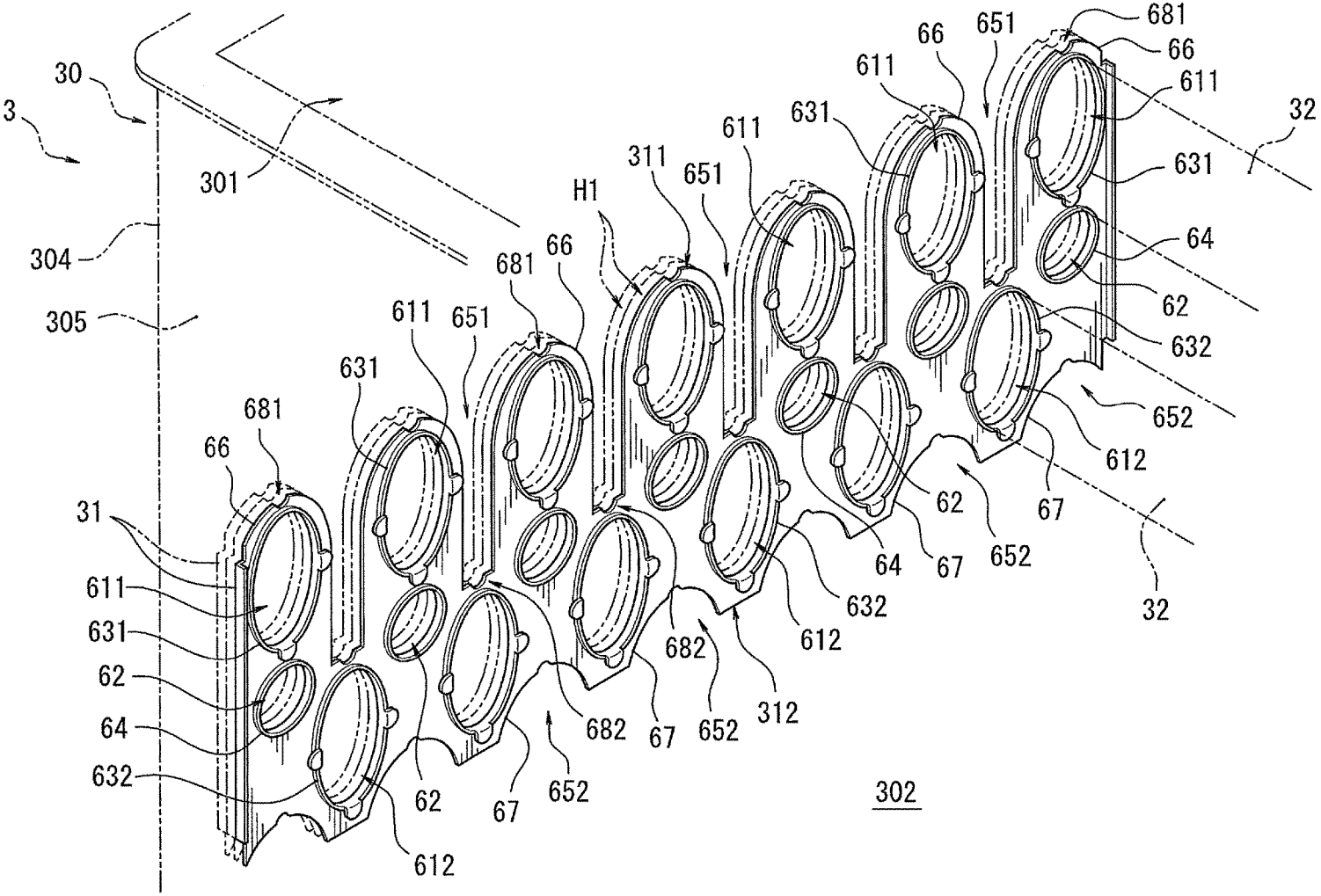
FIG. 3 is a perspective view from a left-front upper position showing one example of the heat transfer fins according to an embodiment of the present invention.
Figure 4:
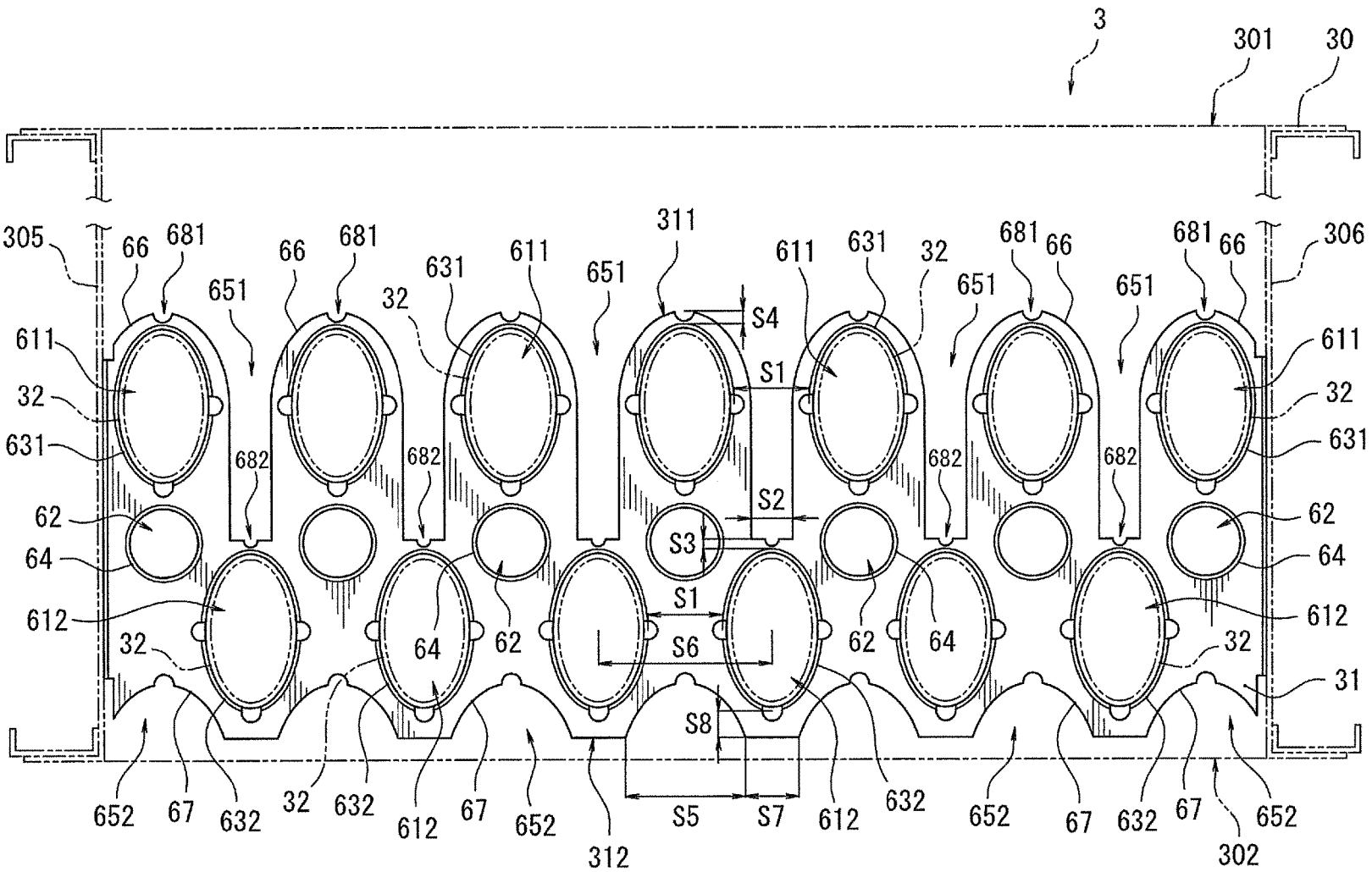
FIG. 4 is a perspective view from a front upper position showing one example of the heat transfer fins according to an embodiment of the present invention.

As illustrated in FIGS. 3 and 4, each of the heat transfer fins 31 has, by burring, a plurality of upper stage heat-transfer-tube insertion holes 611 and lower stage heat-transfer-tube insertion holes 612 (13 holes in total in this example) for inserting the first heat-transfer tubes 32, and a plurality of burring holes 62 (seven holes in this example) for deflecting flow of the combustion exhaust gas introduced from the upper opening 301 of the body 30 into a clearance H1 formed between each of the heat transfer fins 31.

Each of the upper stage and lower stage heat-transfer-tube insertion holes 611, 612 has a substantially elliptical shape elongated in the vertical direction substantially same as an outer shape of the first heat-transfer tube 32. Also, the upper stage and lower stage heat-transfer-tube insertion holes 611, 612 are arranged in a so-called staggered shape such that the upper stage and lower stage heat-transfer-tube insertion holes 611, 612 are divided into two stages of a upper stage and a lower stage in the vertical direction, and center holes of the upper stage heat-transfer-tube insertion holes 611 in the upper stage and center holes of the lower stage heat-transfer-tube insertion holes 612 in the lower stage are displaced from one another by a half pitch in the transverse direction, same as an arrangement of the first heat-transfer tubes 32.

Upper stage and lower stage support flanges 631, 632 each of which has a height substantially equivalent to a height of the clearance H1 are respectively formed so as to project frontward from substantially entire inner circumferences of the upper stage and lower stage heat-transfer-tube insertion holes 611, 612. The respective first heat-transfer tubes 32 are inserted through the upper stage heat-transfer-tube insertion holes 611 or the lower stage heat-transfer-tube insertion holes 612 in directions perpendicular to the heat-transfer fins 31. Connection portions between outer circumferential surfaces of the first heat-transfer tubes 32 and inner circumferential surfaces of the upper stage support flanges 631 are fixed by brazing.

Each of the burring holes 62 is disposed in such a position that a center of the burring hole 62 is located below and in alignment with the vertical center line of the corresponding upper stage heat-transfer-tube insertion hole 611. In addition, each of the burring holes 62 is disposed in such a position that an upper end of the burring hole 62 is located above a lower edge of each of upper end cut portions 651 in the vertical direction (detailed below). Further, each of the burring holes 62 is disposed in such a position that a lower end of the burring hole 62 is located below an upper end of each of the lower stage heat-transfer-tube insertion holes 612. Furthermore, a standing flange 64 having a height substantially equivalent to the height of the clearance H1 between the heat transfer fins 31 is formed so as to project frontward from each of circumferences of the burring holes 62. Accordingly, the combustion exhaust gas introduced from the upper opening 301 into the body 30 passes between the respective upper stage support flanges 631 provided on the circumferential edges of the adjacent upper stage heat-transfer-tube insertion holes 611, further passes between the standing flanges 64 of the burring holes 62 and the lower stage support flanges 632 provided on the circumferential edges of the lower stage heat-transfer-tube insertion holes 612, and flows along side surfaces of the lower stage support flanges 632 toward a fin lower end portion 312.

As illustrated in FIG. 4, a lower end of the outer circumferential surface of each of the standing flanges 64 is located below an upper end of the outer circumferential surface of each of the lower stage support flanges 632. An outside diameter of each of the standing flanges 64 is smaller than each of outer circumferential minor axes of the upper stage and lower stage support flanges 631, 632, and is substantially equivalent to a minimum distance S1 between the two upper stage support flanges 631 adjacent to each other in the transverse direction. The outside diameter of each of the standing flanges 64 may be equivalent to or larger than each of the outer circumferential minor axes of the upper stage and lower stage support flanges 631, 632 as long as the standing flanges 64 do not obstruct flow of the combustion exhaust gas between the standing flanges 64 and the upper stage or lower stage support flanges 631, 632.

The upper end cut portions 651 are respectively formed in a fin upper end portion 311 at center positions between each adjacent pair of the upper stage heat-transfer-tube insertion holes 611 in the transverse direction. Each of the upper end cut portions 651 has a width narrower than each minor axis of the lower stage heat-transfer-tube insertion holes 612. Lower end cut portions 652 each of which has an upward concave and substantially semicircular-arc shape are respectively formed in the fin lower end portion 312 at center positions between each adjacent pair of the lower stage heat-transfer-tube insertion holes 612 in the transverse direction.

Each of the upper end cut portions 651 extends from the fin upper end portion 311 to a position below the lower end of each of the upper stage heat-transfer-tube insertion holes 611 and in the vicinity of the upper end of the corresponding lower stage heat-transfer-tube insertion hole 612. Accordingly, a part of the combustion exhaust gas introduced from the upper opening 301 into the body 30 passes through the upper end cut portions 651 and directly reaches an area around the lower stage heat-transfer-tube insertion holes 612. A width S2 of each of the upper end cut portions 651 is narrower than the outer circumferential minor axis of each of the upper stage support flanges 631. Accordingly, the combustion exhaust gas having passed through the upper end cut portions 651 flows toward the upper ends of the outer circumferential surfaces of the lower stage support flanges 632.

A distance S3 (e.g. 4 mm) between a lower edge of each of the upper end cut portions 651 and the upper end of the outer circumferential surface of the corresponding lower stage support flange 632 is substantially equivalent to a distance S4 between an end edge 66 (hereinafter referred to as "upper end curve edge") of the fin upper end portion 311 above an outer circumference of the corresponding upper stage heat-transfer-tube insertion hole 611 and an upper end of the outer circumferential surface of the corresponding upper stage support flange 631. The distance S3 between the lower edge of the upper end cut portion 651 and the upper end of the outer circumferential surface of the corresponding lower stage support flange 632 may be longer than the distance S4 between the upper end of the outer circumferential surface of the upper stage support flange 631 and the corresponding upper end curve edge 66 as long as brazing is appropriately applicable between the first heat-transfer tube 32 and the lower stage support flange 632.

Each of the lower end cut portions 652 extends from the fin lower end portion 312 to a position above a lower end of each of the lower stage heat-transfer-tube insertion holes 612 in the vertical direction. A side edge 67 of each of the lower end cut portion 652 is formed in a substantially semicircular-arc shape such that the width of the lower end cut portion 652 in the transverse direction increases downward. In other words, each of the side edges 67 is curved from the substantially center between the adjacent lower stage heat-transfer-tube insertion holes 612 obliquely downward toward below each side of the corresponding lower stage heat-transfer insertion hole 612. Accordingly, the drain generated on the surfaces of the heat transfer fins 31 falls toward the lower end cut portions 652, and flows along the side edges 67 to be collected at the fin lower end portion 312 below the lower stage heat-transfer-tube insertion holes 612. Then, the drain drops from the fin lower end portion 312 onto the drain receiver 41 noted above. Each of the side edges 67 may have a linear shape extending from the substantially center between the adjacent lower stage heat-transfer-tube insertion holes 612 obliquely downward toward below each side of the corresponding lower stage heat-transfer insertion hole 612 at a predetermined angle (e.g. 30 degrees outward with respect to the vertical direction).

A width S5 between end edges of each of the lower end cut portions 652 is wider than the minimum distance S1 between the adjacent lower stage support flanges 632 in the transverse direction, but shorter than a distance (pitch) S6 between centers of the adjacent lower stage heat-transfer-tube insertion holes 612. In other words, a distance S7 of the fin lower end portion 312 between the end edges of the adjacent lower end cut portions 652 is shorter than the outer circumferential minor axis of each of the lower stage support flanges 632. The width S5 of each of the lower end cut portions 652 may be shorter than the minimum distance S1 between side surfaces of the adjacent lower stage support flanges 632 as long as the drain remaining between the adjacent lower end cut portions 652 does not obstruct flow of the combustion exhaust gas.

A distance S8 (e.g. 8 mm) between the fin lower end portion 312 and the lower end of the outer circumferential surface of each of the lower stage support flanges 632 is longer than the distance S3 between the lower edge of each of the upper end cut portions 651 and the upper end of the outer circumferential surface of the corresponding lower stage support flange 632.

Each of the upper end curve edges 66 is formed in a substantially upward convex semicircular-arc shape substantially identical to the shape of the side edge 67 of each of the lower end cut portions 652. Each of the upper end curve edges 66 is also formed in a curved shape so as to extend obliquely downward toward each side of the corresponding upper end cut portions 651. Accordingly, a part of the combustion exhaust gas flowing from the upper opening 301 toward an area around the upper stage heat-transfer-tube insertion holes 611 is guided along the upper end curve edges 66 toward the upper end cut portions 651, passes through the upper end cut portions 651, and directly reaches an area around the lower stage heat-transfer-tube insertion holes 612.

Substantially semicircular-arc-shaped upper and lower recesses 681, 682 are formed at the center of each of the upper end curve edges 66, and at the lower edge center of each of the upper end cut portions 651, respectively. When the heat exchanger 3 is assembled, a brazing paste material is applied to each of the upper and lower recesses 681, 682, and heated and melted in a furnace. The melted brazing material flows along the outer circumferential surfaces of the upper stage and lower stage support flanges 631, 632, and further flows toward the respective connection portions between the upper stage and lower stage support flanges 631, 632 and the upper stage and lower stage first heat-transfer tubes 32. Then, the brazing material is hardened by a subsequent cooling step, whereby the heat transfer fins 31 and the first heat-transfer tubes 32 are fixed.

In general, stainless steel-based metal is more difficult to braze than copper-based metal. Accordingly, it is preferable to apply a brazing paste material to connection portions between the first heat-transfer tubes 32 and the upper stage and lower stage support flanges 631, 632 in a preliminary process just before a heating step. From this point of view, according to the heat transfer fins 31 in this embodiment, since the upper end cut portions 651 extend from the fin upper end portion 311 toward positions in the vicinity of the upper ends of the lower stage heat-transfer-tube insertion holes 612, the brazing material is easily applied from the fin upper end portion 311 side to the connection portions between the lower stage heat-transfer-tube holes 612 and the first heat-transfer tubes 32 in the lower stage. Moreover, in an inspection step for checking whether or not appropriate brazing has been made between the heat transfer fins 31 and the first heat-transfer tubes 32, brazing conditions of the connection portions between the lower stage heat-transfer-tube insertion holes 612 and the first heat-transfer tubes 32 in the lower stage are securely recognizable visually or via an inspection camera from the upper opening 301 of the body 30 through the upper end cut portions 651.

As such, according to this embodiment, a part of the combustion exhaust gas introduced through the upper opening 301 into the body 30 flows through the upper end cut portions 651 and directly reaches the area around the lower stage heat-transfer-tube insertion holes 612. This structure allows expansion of the combustion exhaust gas having a sufficient amount of heat throughout the area from the upper opening 301 to the lower stage heat-transfer-tube insertion holes 612, thereby preventing deformation or damage caused by partial overheating. Accordingly, uniform recovery of heat from the combustion exhaust gas is achievable throughout the entire area from the upper end portion 311 to the lower end portion 312 of each of the heat transfer fins 31. Particularly, according to the heat transfer fins 31 of this embodiment, a part of the combustion exhaust gas flowing toward the area around the upper stage heat-transfer-tube insertion holes 611 is guided along the upper end curve edges 66 of the fin upper end portion 311 toward the upper end cut portions 651, and then supplied to the area around the lower stage heat-transfer-tube insertion holes 612. Accordingly, more uniform recovery of heat from the combustion exhaust gas is achievable by the entire heat transfer fins 31, whereby thermal efficiency can be improved.

Also, when the deformation or damage of the heat transfer fin 31 occurs, flow resistance within the body 30 increases, whereby the combustion exhaust gas released from the gas burner 2 may not be introduced into the body 30 smoothly, which results in an incomplete combustion. According to this embodiment, however, the deformation or damage caused by partial overheating of the heat transfer fin 31 can be prevented as discussed above and accordingly, such incomplete combustion of the gas burner 2 is avoidable.

Additionally, according to this embodiment, the combustion exhaust gas having passed between the adjacent upper stage heat-transfer-tube insertion holes 611 flows between the lower stage heat-transfer-tube insertion holes 612 and the standing flanges 64 of the burring holes 62 to the fin lower end portion 312. Namely, since the combustion exhaust gas flows along circumferential edges of the respective lower stage heat-transfer-tube insertion holes 612 (outer circumferential side surfaces of the lower stage support flanges 632), the degree of heat absorption by the heat transfer fins 31 is less variable in the area around the lower stage heat-transfer-tube insertion holes 612. Accordingly, thermal efficiency can be more improved.

Further, according to this embodiment, since the lower end cut portions 652 are formed such that the width of each of the lower end cut portions 652 increases downward, the drain generated on the surfaces of the heat transfer fins 31 flows along the side edges 67 of the lower end cut portions 652 and gathers at the tapered end edges of the fin lower end portion 312 below the lower stage heat-transfer-tube insertion holes 612, and then drops onto the drain receiver 41. Accordingly, it is not likely to be remained the drain at the positions below the areas between the adjacent lower stage heat-transfer-tube insertion holes 612. As a result, poor aeration due to remaining of the drain at the fin lower end portion 312 is not easily caused even when the heat transfer fins 31 are densely arranged in parallel with each other within the body 30. Accordingly, the combustion exhaust gas smoothly flows through the clearances H1 between the respective heat transfer fins 31, whereby thermal efficiency can be further increased.

Furthermore, according to this embodiment, since the plurality of first heat-transfer tubes 32 each having the substantially elliptical cross-sectional shape elongated in the vertical direction are disposed within the body 30 in the two stages of the upper and lower stages in the staggered arrangement, the contact time between the combustion exhaust gas and the surfaces of the respective first heat-transfer tubes 32 increases in comparison with a conventional heat exchanger including a plurality of heat-transfer tubes each having a circular cross-sectional shape and disposed in parallel with each other, whereby thermal efficiency can be further increased. Moreover, each of the heat transfer fins 31 is allowed to have a smaller width in the transverse direction than the corresponding width of the conventional heat exchanger including the plurality of heat-transfer tubes each having the circular cross-sectional shape. Accordingly, the combustion device in more compact and higher thermal efficiency can be obtained.

Further, according to this embodiment, not only the upper end cut portions 651 between the adjacent upper stage heat-transfer-tube insertion holes 611 are formed so as to extend from the fin upper end portion 311 to the positions in the vicinity of the upper ends of the lower stage heat-transfer-tube insertion holes 612, but also the lower end cut portions 652 are formed in the fin lower end portion 312 at the positions below the upper stage heat-transfer-tube insertion holes 611, and further the burring holes 62 are formed between the upper stage heat-transfer-tube insertion holes 611 and the lower stage heat-transfer-tube insertion holes 612. Accordingly, the amount of heat remained in the heat transfer fins 31 after an operation stop decreases by the volumes of the upper end cut portions 651, the lower end cut portions 652, and the burring holes 62. With this, amount of heat transmitted from the heat transfer fins 31 to water in the first heat-transfer tubes 32 can be reduced until an operation is restarted. As a result, it makes possible to avoid supply of hot water having a high outlet temperature at the time of a restart of the operation due to a post-boiling phenomenon.

Since each of the upper end curve edges 66 of the fin upper end portion 311 above the outer circumferences of the upper stage heat-transfer-tube insertion holes 611 has a shape substantially identical to each shape of the side edges 67 of the lower end cut portions 652, a plurality of heat transfer fins 31 successively one above the other are produced at same time by punching one single plate material. Accordingly, a material loss can be decreased, whereby productivity can be improved.

Furthermore, since the heat transfer fins 31 made of stainless steel-based metal is used, it is not likely to be corroded even when the strongly acid drain is generated on the surfaces of the heat transfer fins 31. This advantage lowers the possibility of partial closure of the clearances H1 between the respective heat transfer fins 31 caused by corrosion. Accordingly, each of the clearances H1 between the heat transfer fins 31 is allowed to decrease to a length smaller than that of a conventional heat exchanger including copper-based metal heat transfer fins. As a result, the combustion device in more compact and higher thermal efficiency can be obtained.

Figure 5:
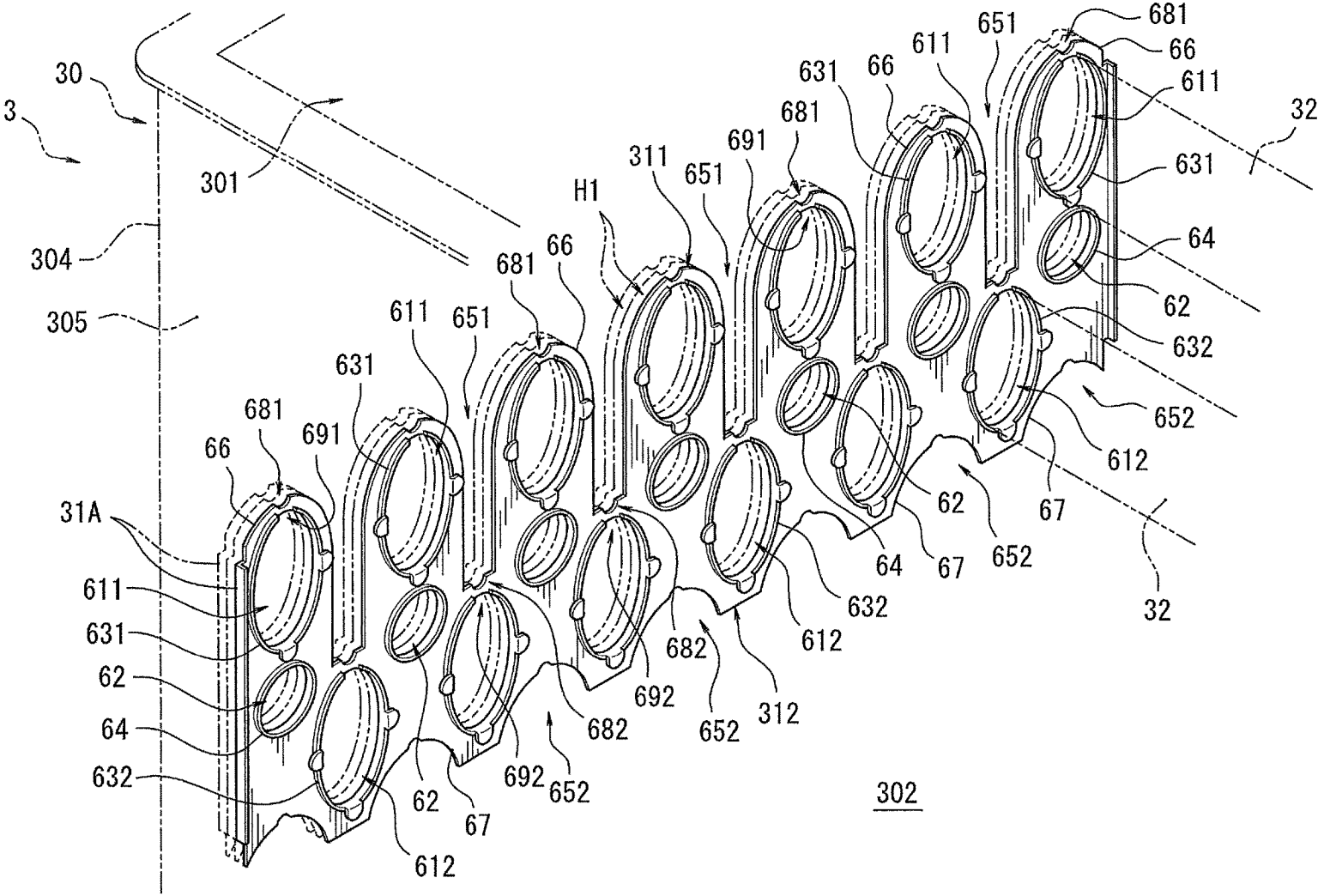
FIG. 5 is a perspective view from a left-front upper position showing another example of heat transfer fins according to an embodiment of the present invention.

According to this embodiment, the heat transfer fin 31 in which the upper stage and lower stage support flanges 631, 632 project from the entire circumferences of the inner circumferential edges of the upper stage and lower stage heat-transfer-tube insertion holes 611, 612, is described. However, a heat transfer fin 31A illustrated in FIG. 5 may be used instead of the heat transfer fin 31. According to the heat transfer fin 31A, upper and lower notches 691, 692 having a predetermined width (e.g. a width wider than that of the upper end opened portion of each recess 681, 682) are formed in each of the upper stage support flanges 631 above the upper ends of the upper stage heat-transfer-insertion holes 611 and each of the lower stage support flanges 632 above the upper ends of the lower stage heat-transfer-tube insertion holes 612, respectively. In addition, the upper recess 681 is formed in each of the upper end curve edges 66 above the upper notch 691 of the corresponding upper stage support flange 631, while the lower recess 682 is formed in each of the lower ends of the upper end cut portions 651 above the lower notch 692 of the corresponding lower stage support flange 632.

According to this embodiment, when the upper stage and lower stage first heat-transfer tubes 32 are respectively connected with the upper stage and lower stage heat-transfer-tube insertion holes 611, 612, a brazing paste material is applied to the upper recesses 681 of the fin upper end portion 311 and the lower recesses 682 of the upper end cut portions 651, respectively. Accordingly, the brazing material melted in a heating step flows through the upper and lower notches 691, 692 toward respective connection portions between the upper stage and lower stage support flanges 631, 632 and the upper stage and lower stage first heat-transfer tubes 32. Then, the brazing material is hardened by a subsequent cooling step, whereby the heat transfer fins 31A and the first heat-transfer tubes 32 are fixed. Accordingly, the heat transfer fins 31A and the first heat-transfer tubes 32 are securely connected with less brazing material.

Meanwhile, the heat transfer fins 31, 31A are configured such that the combustion exhaust gas having passed between the burring holes 62 and the lower stage heat-transfer-tube insertion holes 612 flows between the adjacent the lower stage heat-transfer-tube insertion holes 612 toward the fin lower end portion 312. However, other flanges standing frontward from at least one part of the side edges 67 of the lower end cut portion 652 may be formed as long as the combustion exhaust gas smoothly flows from the fin lower end portion 312 toward the lower opening 302 and the drain falling toward the lower end cut portion 652 smoothly flows along the side edges 67 so as to be guided to the fin lower end portion 312 below the lower stage heat-transfer-tube insertion holes 612. According to this configuration, the combustion exhaust gas flows from upper outer circumferential surfaces of the lower stage support flanges 632 through side surfaces of the lower stage support flanges 632 toward lower outer circumferential surfaces of the lower stage support flanges 632 so as to come around the lower stage support flanges 632. Accordingly, the degree of heat absorption by the heat transfer fins 31, 31A is much less variable in the area around the lower stage heat-transfer-tube insertion holes 612. As a result, thermal efficiency can be more improved.

The heat exchanger 3 described herein is applicable to a heat exchanger incorporated in a combustion device, such as a condensing water heater, a heat source device for a storage water heating system, a water heater having a bath reheating function, a water heater having only a water heating function, a heat source device for a room and water heater, and a hot water room heater.

As described in detail, the present invention is summarized as follows.

According to one aspect of the present invention, there is provided a heat transfer fin made of stainless steel-based metal for a heat exchanger, wherein the heat exchanger has a heat exchanger body in which combustion exhaust gas flows from an upper opening toward a lower opening, and a plurality of the heat transfer fins disposed between two opposed side walls of the heat exchanger body, wherein the heat transfer fins are arranged in parallel with a predetermined clearance therebetween, each of the heat transfer fins comprising:

a plurality of upper stage heat-transfer-tube insertion holes each of which has a substantially elliptical shape elongated in the vertical direction, formed in an upper stage;

a plurality of lower stage heat-transfer-tube insertion holes each of which has a substantially elliptical shape elongated in the vertical direction, formed in an lower stage;

upper end cut portions formed between the adjacent upper stage heat-transfer-tube insertion holes; and lower end cut portions formed between the adjacent lower stage heat-transfer-tube insertion holes, wherein centers of the upper and lower stage heat-transfer-tube insertion holes are displaced from one another in the transverse direction, the upper end cut portions are formed so as to extend from a fin upper end portion beyond lower ends of the upper stage heat-transfer-tube insertion holes to positions in the vicinity of upper ends of the lower stage heat-transfer-tube insertion holes in the vertical direction, the lower end cut portions are formed so as to extend from a fin lower end portion to positions above lower ends of the lower stage heat-transfer-tube insertion holes in the vertical direction, and a width of each of the lower end cut portions in the transverse direction increases downward.

According to the present invention described above, each of the heat transfer fins includes the plurality of upper stage heat-transfer-tube insertion holes each of which the substantially elliptical shape elongated in the vertical direction and the plurality of lower stage heat-transfer-tube insertion holes formed in the lower stage each of which the substantially elliptical shape elongated in the vertical direction. Also, the centers of the upper and lower stage heat-transfer-tube insertion holes are displaced from one another in the transverse direction. Accordingly, the contact time between the combustion exhaust gas and the surfaces of the respective heat-transfer tubes can be increased.

Especially, a part of the combustion exhaust gas introduced from the upper opening into the heat exchange body passes through the upper end cut portions and directly reaches the area around the lower stage heat-transfer-tube insertion holes. Namely, since the combustion exhaust gas having a sufficient amount of heat expands throughout the area from the upper opening to the lower stage heat-transfer-tube insertion holes, it makes possible to not only prevent deformation or damage caused by partial overheating but also achieve uniform recovery of heat from the combustion exhaust gas throughout the entire area from the upper end to the lower end in each of the heat transfer fins.

Further, since each of the lower end cut portions are formed such that the width of each of the lower end cut portions increases downward, the drain generated on the surface of each of the heat transfer fins flows along the side edge of the lower end cut portion to be collected at the fin lower end portion below the correspond lower stage heat-transfer-tube insertion hole. Accordingly, it is not likely to be remained the drain at the positions below the area between the adjacent lower stage heat-transfer-tube insertion holes. As a result, the poor aeration due to remaining of the drain at the fin lower end portion is not easily caused even when the heat transfer fins are densely arranged in parallel with each other. Accordingly, the combustion exhaust gas smoothly flows through the clearances between the respective heat transfer fins.

Further, each of the upper end cut portions formed between the adjacent upper stage heat-transfer-tube insertion holes extends from the fin upper end portion to the position in the vicinity of the upper end of the lower stage heat-transfer-tube insertion hole and each of the lower end cut portions formed between the adjacent lower upper stage heat-transfer-tube insertion holes extends from the fin lower end portion to the position above the lower end of the lower stage heat-transfer-tube insertion hole in the vertical direction. Accordingly, the amount of heat remained in the heat transfer fins after an operation stop decreases by the volumes of the upper end cut portions and the lower end cut portions. As a result, amount of heat transmitted from the heat transfer fins to water in the heat-transfer tubes can be reduced until an operation is restarted.

Preferably, the heat transfer fin described above further comprising:

burring holes below the upper stage heat-transfer-tube insertion holes, wherein an upper end of each of the burring holes is located above a lower edge of each of the upper end cut portions in the vertical direction, and a lower end of each of the burring holes is located below an upper end of each of the lower stage heat-transfer-tube insertion holes in the vertical direction.

According to the present invention described above, the combustion exhaust gas having passed between the adjacent upper stage heat-transfer-tube insertion holes flows between the lower stage heat-transfer-tube insertion holes and the standing flanges of the burring holes to the fin lower end portion. Namely, since the combustion exhaust gas flows along the circumferential edges of the respective lower stage heat-transfer-tube insertion holes, the degree of heat absorption by the heat transfer fins is less variable in the area around the lower stage heat-transfer-tube insertion holes.

Preferably, in the heat transfer fin described above, an end edge of the fin upper end portion above an outer circumference of each of the upper stage heat-transfer-tube insertion holes has a shape substantially identical to each shape of the side edges of the lower end cut portions.

According to the present invention described above, since the end edge of the fin upper end portion above the outer circumference of each of the upper stage heat-transfer-tube insertion holes is also formed in a curved shape so as to extend obliquely downward same as the side edge of each of the lower end cut portions, a part of the combustion exhaust gas flowing toward the area around the upper stage heat-transfer-tube insertion holes is guided along the end edges of the fin upper end portion toward the upper end cut portions, and then supplied to the area around the lower stage heat-transfer-tube insertion holes. Accordingly, uniform recovery of heat from the combustion exhaust gas is achievable throughout the entire area from the fin upper end portion to the fin lower end portion. Further, since each of the end edges of the fin upper end portion above the outer circumferences of the upper stage heat-transfer-tube insertion holes has a shape substantially identical to each shape of the side edges of the lower end cut portions, the plurality of heat transfer fins successively one above the other are produced at same time by punching one single plate material. Accordingly, a material loss can be decreased.

Preferably, the heat transfer fin described above further comprising:

upper stage support flanges formed along circumferential edges of the upper stage heat-transfer-tube insertion holes, wherein each of the upper stage support flanges has an upper notch in the vicinity of an upper end of the corresponding upper stage heat-transfer-tube insertion hole, and an end edge of the fin upper end portion above an outer circumference of each of the upper stage heat-transfer-tube insertion holes has an upper recess above the upper notch of the corresponding upper stage support flange.

According to the present invention described above, since the upper stage support flanges are formed along the circumferential edges of the upper stage heat-transfer-tube insertion holes, it makes possible to enlarge contact areas between the heat transfer fins and the heat-transfer tubes inserted through the upper stage heat-transfer-tube insertion holes. Accordingly, heat recovered by the heat transfer fins can be uniformly transmitted to the entire surface of each of the heat-transfer tubes in the upper region.

Further, while each of the upper stage support flanges has the upper notch in the vicinity of the upper end of the corresponding upper stage heat-transfer-tube insertion hole, the end edge of the fin upper end portion above the upper notch of the corresponding upper stage support flange has the upper recess. Accordingly, when the heat-transfer tubes in the upper stage are respectively connected with the upper stage heat-transfer-tube insertion holes by brazing, a brazing paste material applied to the upper recesses of the fin upper end portion flows through the upper notches toward the area around the upper stage heat-transfer-tube insertion holes. As a result, the heat transfer fins and the heat-transfer tubes are securely connected with less brazing material.

Preferably, the heat transfer fin described above further comprising:

lower stage support flanges formed along circumferential edges of the lower stage heat-transfer-tube insertion holes, wherein each of the lower stage support flanges has a lower notch in the vicinity of the upper end of the corresponding lower stage heat-transfer-tube insertion hole, and an lower edge of the upper end cut portion above the lower notch of each of the lower stage support flanges has a lower recess.

According to the present invention described above, since the lower stage support flanges are formed along the circumferential edges of the lower stage heat-transfer-tube insertion holes, it makes possible to enlarge contact areas between the heat transfer fins and the heat-transfer tubes inserted through the lower stage heat-transfer-tube insertion holes. Accordingly, heat recovered by the heat transfer fins can be uniformly transmitted to the entire surface of each of the heat-transfer tubes in the lower region.

Further, while each of the lower stage support flanges has the lower notch in the vicinity of the upper end of the corresponding lower stage heat-transfer-tube insertion hole, the lower edge of the upper end cut portion above the lower notch of each of the lower stage support flanges has the lower recess. Accordingly, when the heat-transfer tubes in the lower stage are connected with the lower stage heat-transfer-tube insertion holes by brazing, a brazing paste material applied to the lower recesses of the upper end cut portions flows through the lower notches toward the area around the lower stage heat-transfer-tube insertion holes. As a result, the heat transfer fins and the heat-transfer tubes are securely connected with less brazing material.

According to another aspect of the present invention, there is provided a heat exchanger comprising:

the heat transfer fins described above;

a heating exchanger body; and a plurality of heat-transfer tubes each of which has a substantially elliptic cross-sectional shape elongated in the vertical direction, wherein each of the heat-transfer tubes is inserted through the corresponding upper stage heat-transfer-tube insertion holes or the corresponding lower stage heat-transfer-tube insertion holes of the heat transfer fins in the direction perpendicular to the heat transfer fins between two opposed side walls of the heat exchanger body.

According to the present invention described above, since a part of the combustion exhaust gas introduced from the upper opening into the heat exchanger body passes through the upper end cut portions and directly reaches the area around the lower stage heat-transfer-tube insertion holes, it makes possible to prevent deformation or damage caused by partial overheating of the heat transfer fins. Accordingly, uniform recovery of heat from the combustion exhaust gas is achievable throughout the entire area from the upper end portion to the lower end portion of the heat transfer fin.

In addition, since the lower end cut portions are formed such that the width of each of the lower end cut portions increases downward, the drain generated on the surface of the heat transfer fin flows along the side edges to be collected at the fin lower end portion. Accordingly, it is not likely to be remained the drain at the positions below a space between the adjacent heat-transfer tubes. As a result, the poor aeration due to remaining of the drain at the fin lower end portion is not easily caused even when the heat transfer fins are densely arranged. Accordingly, the combustion exhaust gas can smoothly flow through the clearances between the respective heat transfer fins.

Further, the plurality of heat-transfer tubes each of which has the substantially elliptic cross-sectional shape elongated in the vertical direction are respectively inserted through the corresponding upper stage heat-transfer-tube insertion holes or the corresponding lower stage heat-transfer-tube insertion holes in the direction perpendicular to the heat transfer fins between the two opposed side walls of the heat exchanger body. Furthermore, the centers of the heat-transfer tubes in the upper and lower stages are displaced from one another in the transverse direction. Accordingly, the contact time between the combustion exhaust gas and the surfaces of the respective heat-transfer tubes increases in comparison with a conventional heat exchanger including a plurality of heat-transfer tubes each having a circular cross-sectional shape.

Moreover, each of the upper end cut portions formed between the adjacent upper stage heat-transfer-tube insertion holes extends from the fin upper end portion to the position in the vicinity of the upper end of the corresponding lower stage heat-transfer-tube insertion hole and each of the lower end cut portions formed between the adjacent lower stage heat-transfer-tube insertion holes extends from the fin lower end portion to the position above the lower end of the corresponding lower stage heat-transfer-tube insertion hole in the vertical direction. Accordingly, the amount of heat remained in the heat transfer fins after an operation stop decreases by the volumes of the upper end cut portions and the lower end cut portions. As a result, amount of heat transmitted from the heat transfer fins to water in the heat-transfer tubes can be reduced until an operation is restarted.

As described above, according to the present invention, the contact time between the combustion exhaust gas and the surfaces of the respective heat-transfer tubes can be increased and uniform recovery of heat from the combustion exhaust gas can be achieved throughout the entire area from the upper end portions to the lower end portions of the heat transfer fins, whereby the heat efficiency can be improved. Further, the poor aeration due to remaining of the drain at the fin lower end portions is not easily caused and accordingly, the combustion exhaust gas can smoothly flows through the clearances between the respective heat transfer fins, whereby the thermal efficiency can be further improved. Moreover, the amount of heat transmitted from the heat transfer fins to water in the heat-transfer tubes can be reduced until an operation is restarted and accordingly, it makes possible to prevent supply of hot water having high temperature at the time of a restart of the operation due to the post-boiling phenomenon.

The present application claims a priority based on a Japanese Patent Application No. 2015-51698 filed on Mar. 16, 2015, the content of which is hereby incorporated by reference in its entirely.

Although the present invention has been described in detail, the foregoing descriptions are merely exemplary at all aspects, and do not limit the present invention thereto. It should be understood that an enormous number of unillustrated modifications may be assumed without departing from the scope of the present invention.

The invention claimed is:

1. A heat transfer fin made of stainless steel-based metal capable of use in a heat exchanger, wherein the heat exchanger has a heat exchanger body in which combustion exhaust gas flows from an upper opening toward a lower opening, and a plurality of heat transfer fins disposed between two opposed side walls of the heat exchanger body, wherein the plurality of heat transfer fins are arranged in parallel with a predetermined clearance therebetween;

the heat transfer fin comprising:

a plurality of upper stage heat-transfer-tube insertion holes each of which has a substantially elliptical shape elongated in a vertical direction, formed in an upper stage;

a plurality of lower stage heat-transfer-tube insertion holes each of which has a substantially elliptical shape elongated in the vertical direction, formed in a lower stage;

upper end cut portions formed between adjacent ones of the plurality of upper stage heat-transfer-tube insertion holes;

lower end cut portions formed between adjacent ones of the plurality of lower stage heat-transfer-tube insertion holes;

upper stage support flanges formed along circumferential edges of the plurality of upper stage heat-transfer-tube insertion holes;

lower stage support flanges formed along circumferential edges of the plurality of lower stage heat-transfer-tube insertion holes;

burring holes formed below the plurality of upper stage heat-transfer-tube insertion holes; and standing flanges formed along circumferential edges of the burring holes, wherein centers of the plurality of upper stage heat-transfer-tube insertion holes and the plurality of lower stage heat-transfer-tube insertion holes are displaced from one another in a transverse direction, the upper end cut portions are formed so as to extend from a fin upper end portion beyond lower ends of the plurality of upper stage heat-transfer-tube insertion holes to positions adjacent to upper ends of the plurality of lower stage heat-transfer-tube insertion holes in the vertical direction, the lower end cut portions are formed so as to extend from a fin lower end portion to positions above lower ends of the plurality of lower stage heat-transfer-tube insertion holes in the vertical direction, a width of each of the lower end cut portions in the transverse direction increases downward, the burring holes are substantially circular holes, the lower end cut portions have a substantially semicircular shape, the plurality of upper stage heat-transfer-tube insertion holes, the burring holes, and the lower end cut portions are disposed in the transverse direction in such a manner that a center of each of the burring holes and a center of each of the lower end cut portions are in alignment with a vertical center line of each of the plurality of upper stage heat-transfer-tube insertion holes located thereabove, the burring holes are disposed in the vertical direction in such a manner that an upper end of each of the burring holes is located above a lower edge of each of the upper end cut portions and a lower end of each of the burring holes is located below the upper end of each of the plurality of lower stage heat-transfer-tube insertion holes, and an outside diameter of each of the standing flanges is smaller than an outside diameter of each of the upper stage support flanges located thereabove and is equivalent to a minimum distance between adjacent ones of the plurality of lower stage heat-transfer-tube insertion holes.

2. The heat transfer fin according to claim 1, wherein an end edge of the fin upper end portion above an outer circumference of each of the plurality of upper stage heat-transfer-tube insertion holes has a substantially identical shape to a side edge of the lower end cut portions located below each of the plurality of upper stage heat-transfer-tube insertion holes.

3. The heat transfer fin according to claim 1, wherein each of the upper stage support flanges has an upper notch adjacent to an upper end of a corresponding one of the plurality of upper stage heat-transfer-tube insertion holes, and an end edge of the fin upper end portion above an outer circumference of each of the upper stage heat-transfer-tube insertion holes has an upper recess above the upper notch of a corresponding one of the plurality of upper stage support flanges.

4. The heat transfer fin according to claim 1, wherein each of the lower stage support flanges has a lower notch adjacent to the upper end of a corresponding one of the plurality of lower stage heat-transfer-tube insertion holes, and a lower edge of the upper end cut portions above the lower notch of each of the lower stage support flanges has a lower recess.

5. A heat exchanger comprising:

a plurality of heat transfer fins according to the heat transfer fin of claim 1;

a heat exchanger body; and a plurality of heat-transfer tubes each of which has a substantially elliptical cross-sectional shape elongated in the vertical direction, wherein each of the plurality of heat-transfer tubes is inserted through a corresponding one of the plurality of upper stage heat-transfer-tube insertion holes or a corresponding one of the plurality of lower stage heat-transfer-tube insertion holes of the plurality of heat transfer fins in a direction perpendicular to the plurality of heat transfer fins between two opposed side walls of the heat exchanger body.

* * * * *